US006942300B2

(12) United States Patent
Numa et al.

(10) Patent No.: US 6,942,300 B2
(45) Date of Patent: Sep. 13, 2005

(54) STRUCTURE FOR MOUNTING A NET MEMBER TO A FRAME FOR A SEAT OR BACKREST OF A CHAIR

(75) Inventors: Naoki Numa, Yokohama (JP); Tetsuya Narita, Funabashi (JP); Ryo Igarashi, Tokyo (JP)

(73) Assignee: Okamura Corporation (JP)

( * ) Notice: Subject to any disclaimer, the term of this patent is extended or adjusted under 35 U.S.C. 154(b) by 40 days.

(21) Appl. No.: 10/625,076

(22) Filed: Jul. 22, 2003

(65) Prior Publication Data

US 2004/0124689 A1 Jul. 1, 2004

(30) Foreign Application Priority Data

| | | |
|---|---|---|
| Jul. 23, 2002 | (JP) | 2002-213453 |
| Sep. 26, 2002 | (JP) | 2002-281552 |
| Oct. 15, 2002 | (JP) | 2002-301051 |
| Oct. 17, 2002 | (JP) | 2002-302463 |

(51) Int. Cl.[7] ..... A47C 31/02; A47C 7/02

(52) U.S. Cl. ..... 297/452.56; 297/218.3; 297/218.5; 297/440.11

(58) Field of Search ..... 297/452.56, 440.11, 297/218.3, 218.5

(56) References Cited

U.S. PATENT DOCUMENTS

| | | | | |
|---|---|---|---|---|
| 3,041,109 A | * | 6/1962 | Eames et al. | 297/440.11 X |
| 3,298,743 A | * | 1/1967 | Albinson et al. | 297/218.5 X |
| 3,300,251 A | * | 1/1967 | Helms | 297/218.5 X |
| 4,062,590 A | * | 12/1977 | Polsky et al. | 297/452.56 |
| 5,067,773 A | * | 11/1991 | Koa | 297/218.3 X |
| 6,059,368 A | * | 5/2000 | Stumpf et al. | 297/440.11 |
| 6,254,190 B1 | * | 7/2001 | Gregory | 297/440.11 X |
| 6,378,944 B1 | * | 4/2002 | Weisser | 297/440.11 |
| 6,406,093 B1 | * | 6/2002 | Miotto et al. | 297/218.5 |
| 6,550,866 B1 | * | 4/2003 | Su | 297/452.56 X |
| 6,623,079 B2 | * | 9/2003 | Gregory | 297/440.11 |
| 6,626,497 B2 | * | 9/2003 | Nagamitsu et al. | 297/452.56 X |
| 6,702,390 B2 | * | 3/2004 | Stumpf et al. | 297/452.56 |
| 6,722,741 B2 | * | 4/2004 | Stumpf et al. | 297/452.56 X |
| 6,733,080 B2 | * | 5/2004 | Stumpf et al. | 297/452.56 X |
| 2002/0195863 A1 | * | 12/2002 | Su | 297/440.11 |
| 2003/0071509 A1 | * | 4/2003 | Neil et al. | 297/440.11 |
| 2003/0160494 A1 | * | 8/2003 | Coffield | 297/440.11 |

FOREIGN PATENT DOCUMENTS

| | | |
|---|---|---|
| JP | 8-507935 | 8/1996 |
| JP | 11-244103 | 9/1999 |
| JP | 3075192 | 11/2000 |
| JP | 2001-8774 | 1/2001 |
| JP | 2001-78852 | 3/2001 |
| JP | 2001-89959 | 4/2001 |
| JP | 2001-128805 | 5/2001 |
| JP | 2002-165672 | 11/2002 |

* cited by examiner

*Primary Examiner*—Rodney B. White
(74) *Attorney, Agent, or Firm*—Ostrolenk, Faber, Gerb & Soffen, LLP

(57) ABSTRACT

A net member is stretched over a frame for a seat and backrest of a chair. An engagement member attached to the end of the net member is inserted into an engagement groove on the lower surface of the basic frame. A binding frame is pressed onto the lower surface of the basic frame and the net member is fixed between the basic frame and the binding frame by the engagement piece.

Warps are woven or knitted in a mesh structure over the seat and backrest to wefts comprising elastic yarns and chenille yarns.

26 Claims, 16 Drawing Sheets

STRUCTURE FOR MOUNTING A NET MEMBER TO A FRAME FOR A SEAT OR BACKREST OF A CHAIR

BACKGROUND OF THE INVENTION

The present invention relates to the structure for mounting a net member to a frame for a seat and the backrest of a chair, a method of mounting the net member to the frame and a chair with a mesh in which warps are woven or knitted with wefts.

In a conventional seat structure of a chair in which a high tension elastic net member including a porous plate is stretched over a closed-loop seat frame, the outer periphery of the net member is put over the upper outer side surface of the seat frame and folded into the lower surface of the seat frame. The folded portion is fixed to the seat frame by a screw. Japanese Patent Publications No.11-244103 and 2002-165672 disclose the structure.

However, it is not an easy procedure to mount the outer periphery of the net member to the seat frame at non-uniform tensile force. It requires much labor, and owing to non-uniform tensile force. Wrinkles and slacks occur in connected portions of the net member. Excessive tensile force is applied to the net member around a bonding bolt which causes cracking.

Furthermore, there is a mesh-stretched chair as disclosed in Japanese Patent Publication No.8-507935. However, elastomonomer filaments 374 are crossed to strands 376 in the chair causing slippage. The mesh pattern which appears on the surface is not only monotypic but also likely to slip, so that it is difficult to obtain frictional force enough to hold a sitting person.

Tensile strength is not suitably applied to the seat in a depth direction and the backrest in a vertical direction. So the seat and backrest do not provide enough elasticity.

SUMMARY OF THE INVENTION

In view of the disadvantages, it is a principal object of the present invention to provide the structure for stretching a net member to a frame of a seat or backrest of a chair by a relatively simple low uniform tensile force.

It is another object of the present invention to provide a method of stretching a net member over a frame of a seat or backrest of a chair uniformly and simply.

It is a further object of the present invention to provide a mesh-stretched chair having suitable comfort and appearance without slippage of fibers to provide frictional enough force to hold a sitting person.

BRIEF DESCRIPTION OF THE DRAWINGS

The foregoing and other features and advantages of the invention will become more apparent from the following description with respect to embodiments as shown in appended drawings wherein.

DETAILED DESCRIPTION OF PREFERRED EMBODIMENTS

Figure 1:
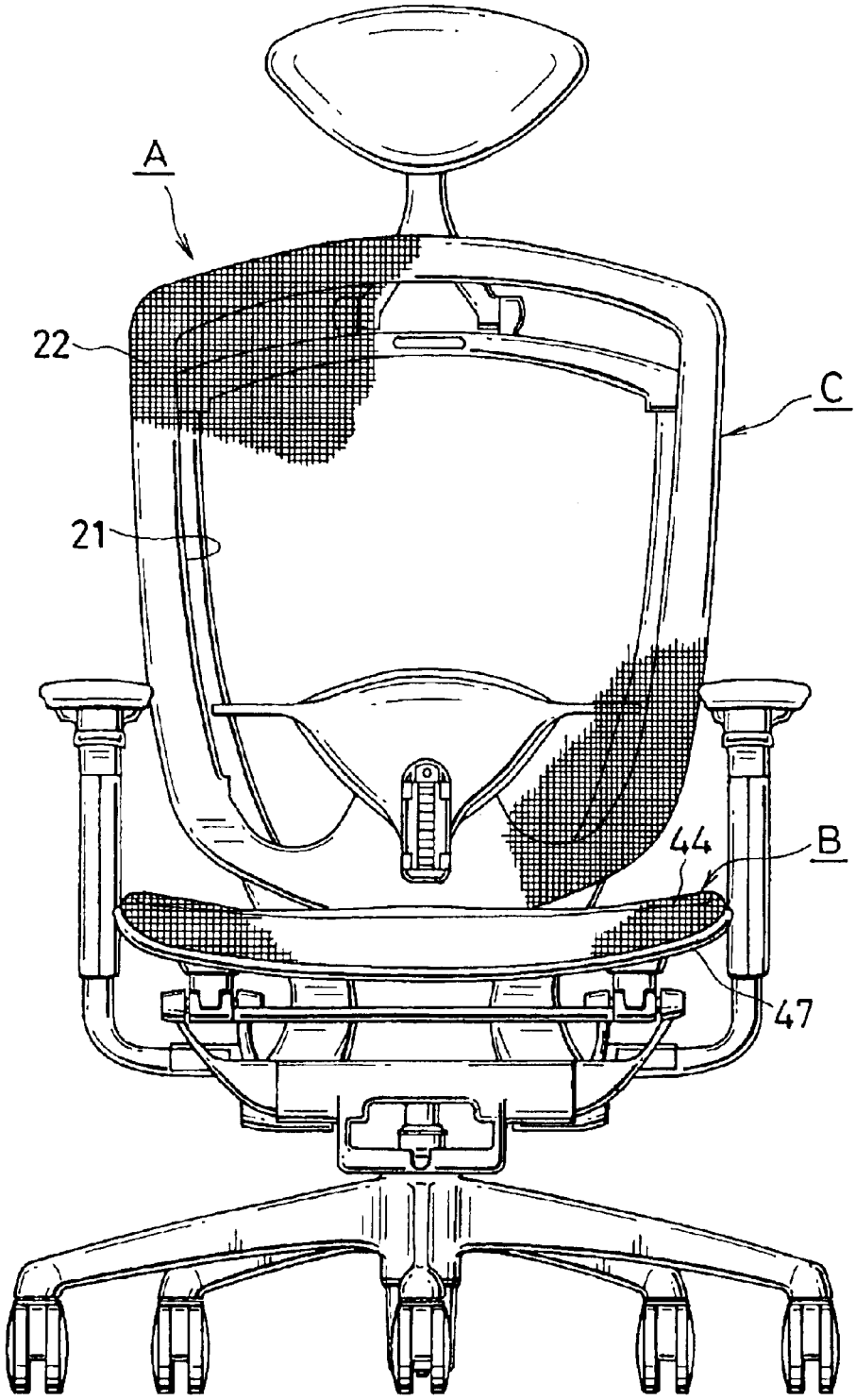
FIG. 1 is a front elevational view of a chair having the structure for mounting a net member to a frame for a seat or backrest according to the present invention.
Figure 2:
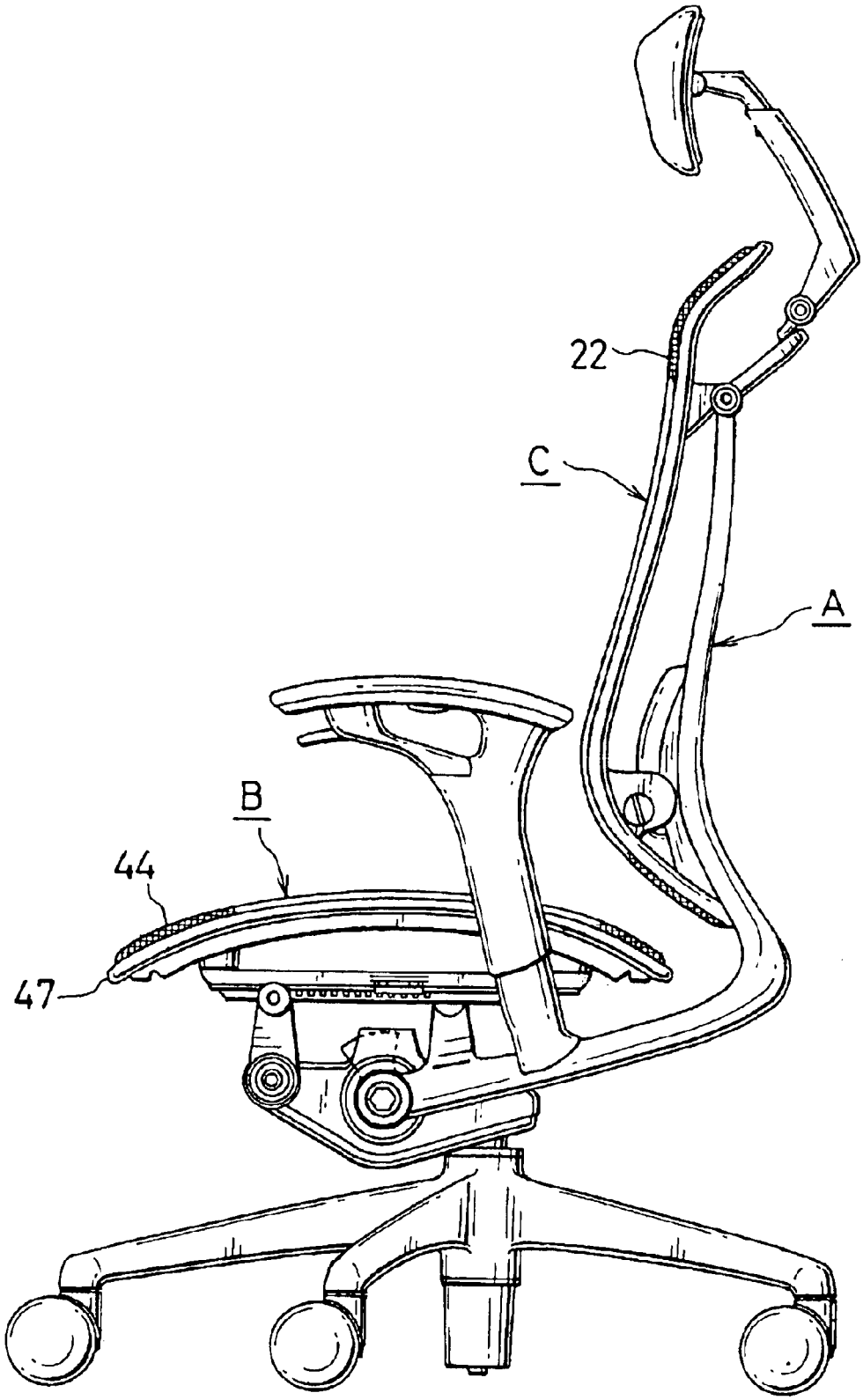
FIG. 2 is a right side elevational view thereof.
Figure 3:
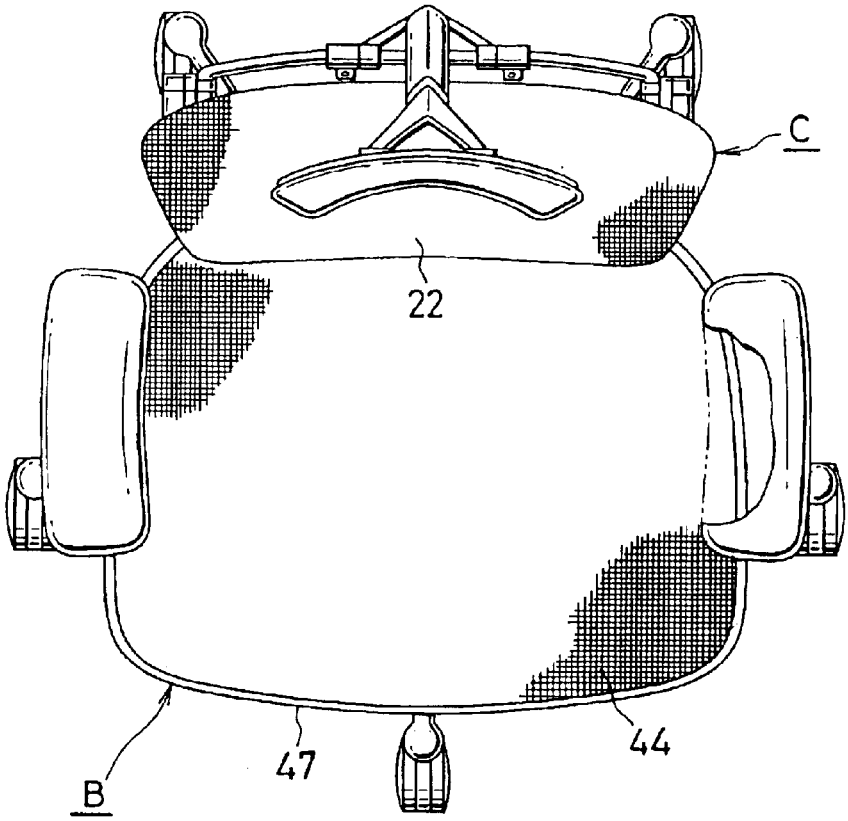
FIG. 3 is a top plan view thereof.

FIG. 1 is a front elevational view of a chair "A" having the structure for mounting a net member to a frame for a seat or backrest, FIG. 2 is a right side elevational view thereof, and FIG. 3 is a top plan view thereof.

The first embodiment of the present invention will be described. The present invention is applied not only to a seat "B" of a chair "A" in FIG. 2 but also to the backrest "C" of the chair "A".

Figure 4:
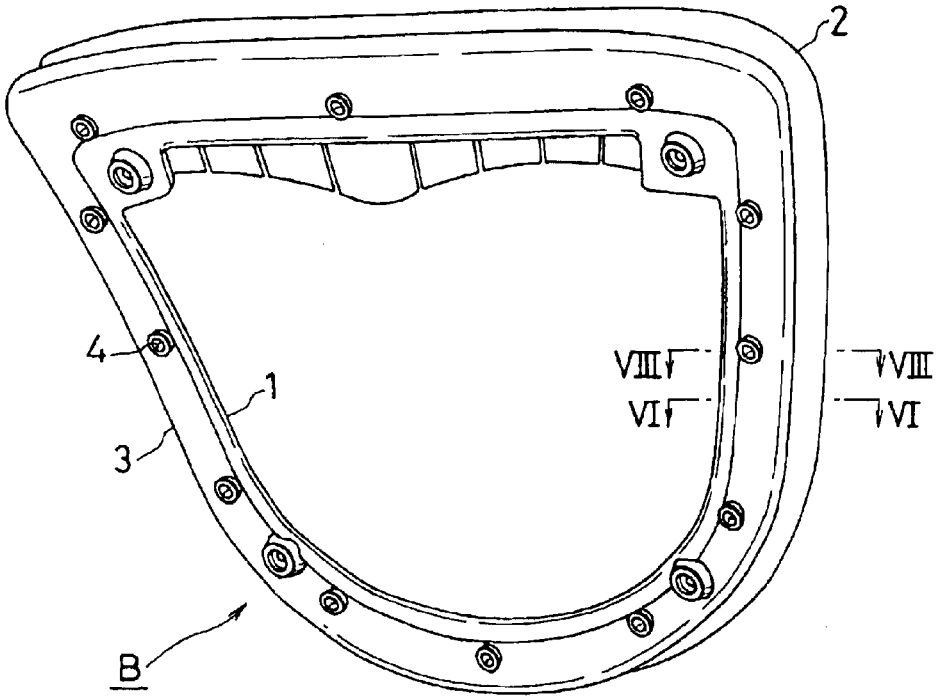
FIG. 4 is a perspective view of a seat in FIG. 1.
Figure 5:
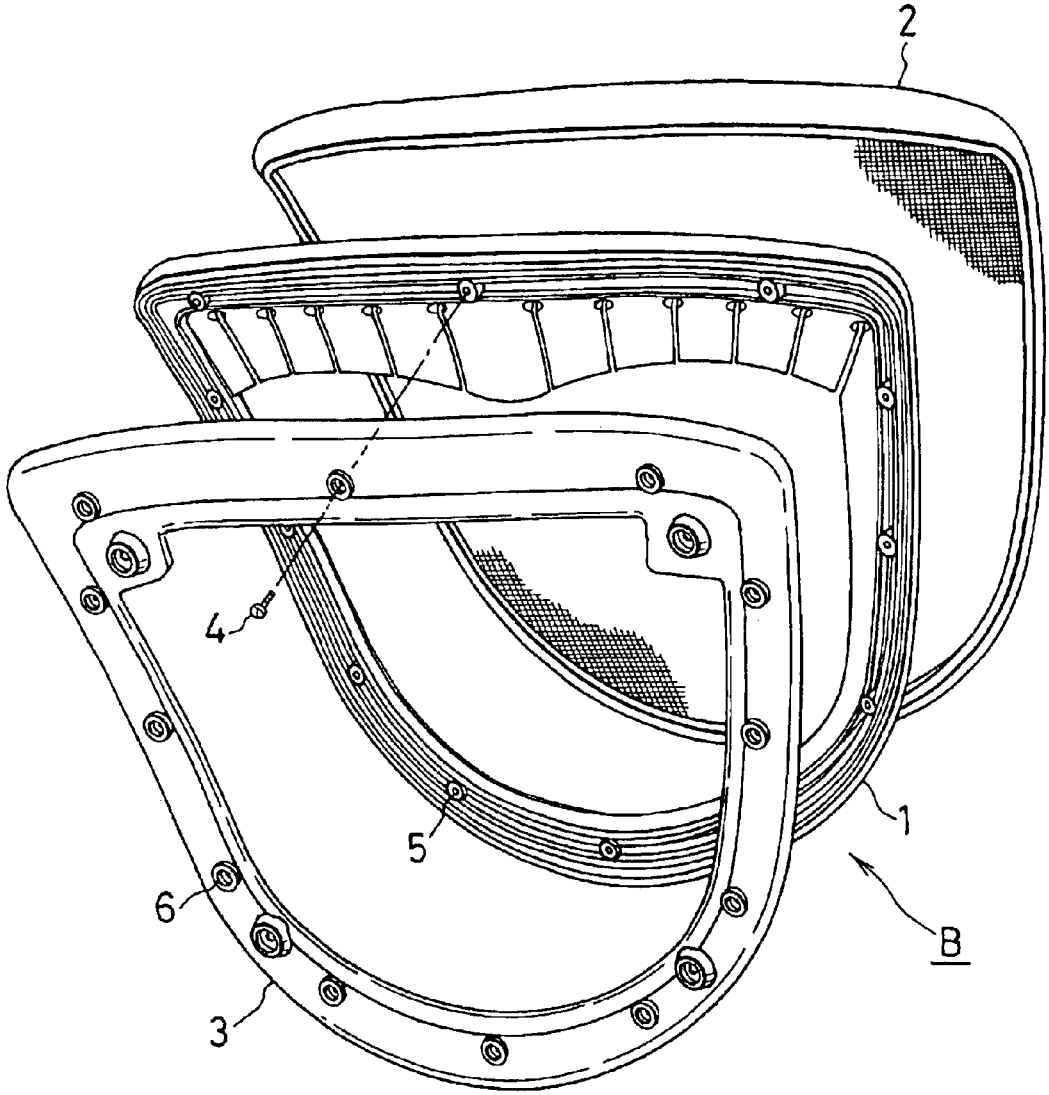
FIG. 5 is an exploded perspective view thereof.

As shown in FIGS. 4 and 5, in the seat "B", the periphery of a net member 2 such as high tension plastic is put on the outer periphery of a closed-loop seat frame 1, and folded. A binding frame 3 similar to the seat frame 1 in shape is put on the lower surface of a folded portion 2*a* and bound by bolts 4.

There are formed a plurality of threaded bores 5 and through-bores 6 which are corresponding to each other in position in the lower surface of the seat frame 1 and the binding frame 3 respectively.

Figure 6:
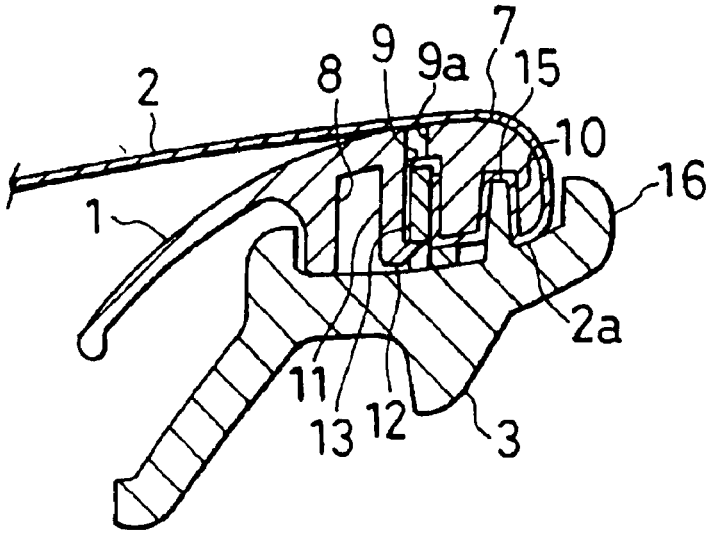
FIG. 6 is an enlarged vertical sectional view taken along the line VI—VI in FIG. 4.
Figure 7:
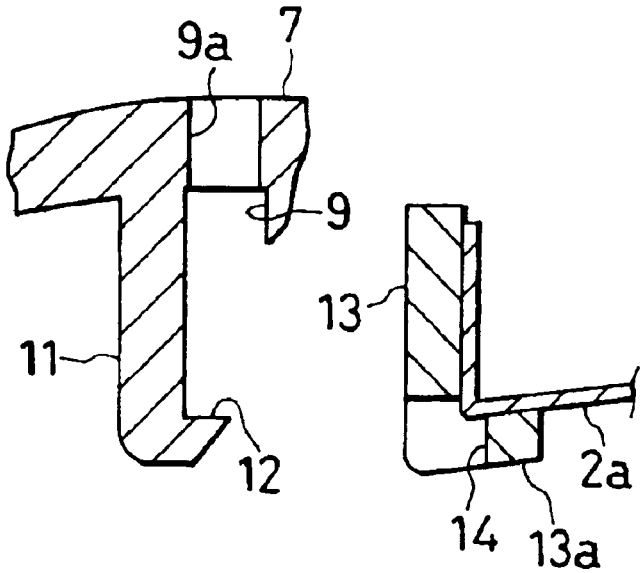
FIG. 7 is an enlarged sectional view of part of a seat frame and an engagement piece.
Figure 10:
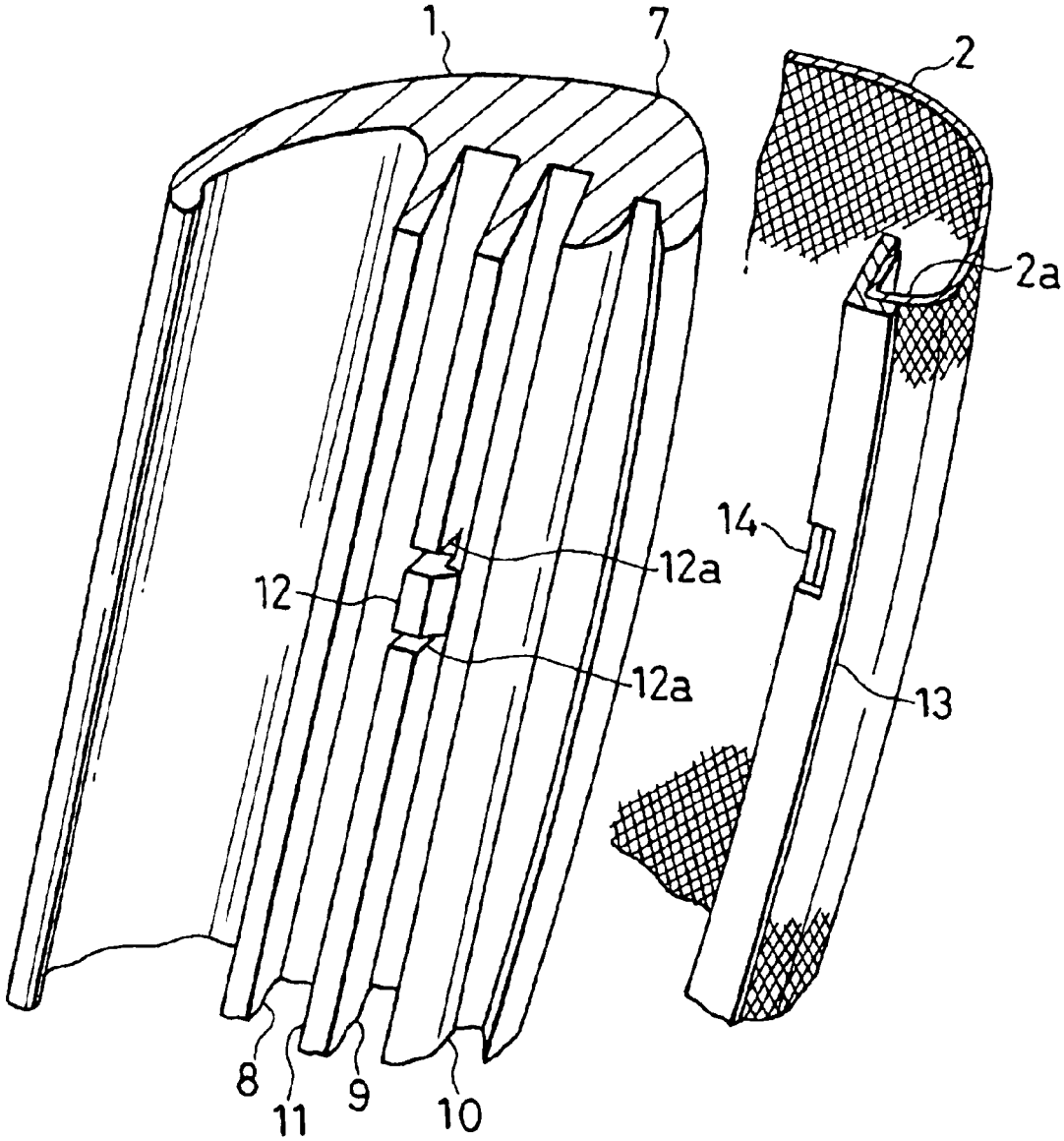
FIG. 10 is a perspective view of the seat frame and a net member.

As shown in FIG. 6, the folded portion 2*a* of the net member 2 is held between the seat frame 1 and the binding frame 3 as below. The outer periphery 7 of the seat frame 1 comprises a hard thickened portion, and the lower surface of the periphery 7 has an annular clearance groove 8, an annular engagement groove 9 and an annular form-fitting groove 10. A partition wall 11 between the inner annular clearance groove 8 and the middle annular engagement groove 9 is relatively thin, and has a plurality of notches 12*a* as shown in FIG. 10. Between the adjacent notches 12*a*, there is a flexible engagement claw 12. A through-bore 9*a* is formed at the top of the annular engagement groove 9. The outer annular form-fitting groove 10 has a trapezoidal section.

The net member 2 is put over the outer side surface and folded onto the lower surface of the thick outer periphery 7 of the seat frame 1 over the whole circumference. An L-sectioned engagement piece 13 is inserted upward into the annular engagement groove 9. The engagement piece 13 is made of a soft synthetic resin and has a horizontal portion 13*a*. An engagement recess 14 is formed on the engagement piece 13 at a position corresponding to the flexible engagement claw 12.

The width of the net member 2 and position of the engagement piece 13 are determined so that its tensile force is set to a desired fixed value when the net member 2 is tightened.

The upper surface of the binding frame 3 is concave to engage with the thick outer periphery 7 of the seat frame 1, and a projection 15 is engaged in the annular form-fitting groove 10 of the seat frame 1 while the net member 2 is put between the projection 15 and the groove 10. At the outer periphery of the binding frame 3, an upward protection flange 16 is engaged on the lower periphery of the seat frame 1.

To mount the net member 2 on the seat frame 1, first, the net member 2 is put over the thick outer periphery 7 of the seat frame 1, folded inward and downward, and cut when the outer end of the net member 2 comes to the annular engagement groove 9 of the thickened portion 7. The L-shaped engagement piece 13 is attached to the net member 2 by suitable means such as adhesive.

Then, the net member 2 is put over the seat frame 1 and folded inward. The L-shaped engagement piece 13 is put into the annular engagement groove 9 with the net member 2. The binding frame 3 is placed under the seat frame 1, and the engagement piece 13 is pushed upward with the net member 1 by the binding frame 3 beyond the flexible engagement claw 12 thereby preventing the engagement piece 13 from coming out by engaging the engagement claw 12 engaged with the engagement groove 14 of the piece 13.

Furthermore, the projection 15 of the binding frame 3 comes into the annular form-fitting groove 10 of the seat frame 1, so that the net member 2 is strongly pressed in the annular form-fitting groove 10.

The annular engagement groove 9 and annular form-fitting groove 10 are formed over the whole circumference of the binding frame 3, and the engagement piece 13 is put over the whole circumference of the net member 2, so that uniform tensile force is applied to the whole surface of the net member 2. Thus, the net member 2 is strongly tightened with good form.

Instead of the continuous annular grooves 8, 9, 10, they may be partially separated.

An annular form-fitting groove may be formed on the upper surface of the binding frame 3, while a projection may be provided on the outer periphery 7 of the seat frame 1.

Figure 8:
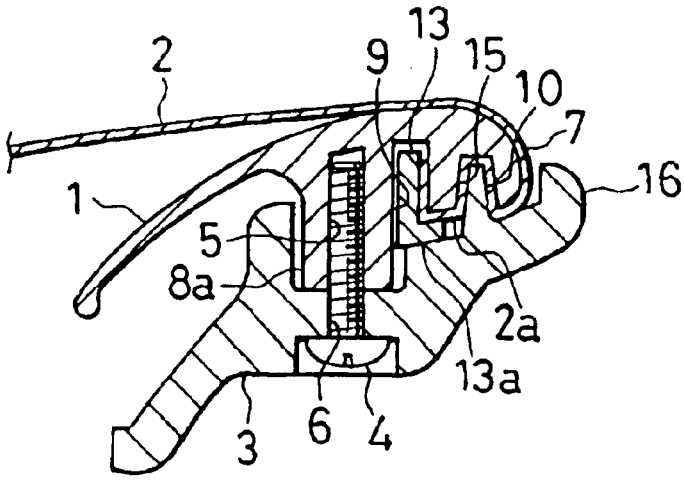
FIG. 8 is an enlarged vertical sectional view taken along the line VIII—VIII in FIG. 4.
Figure 9:
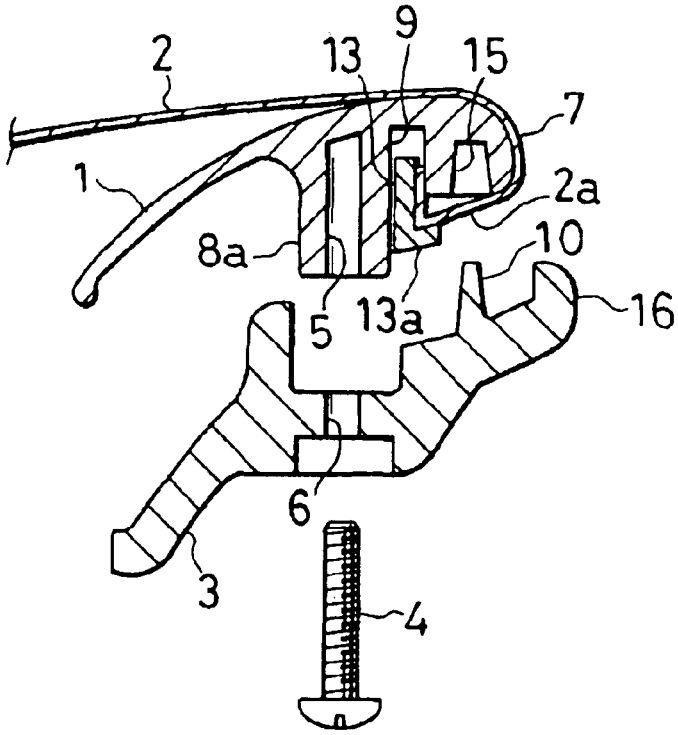
FIG. 9 is an enlarged exploded sectional view of FIG. 8.

FIG. 8 is a vertical sectional view taken along the line VIII—VIII in FIG. 4 and FIG. 9 is an exploded perspective view thereof. The net member 2 is folded on the seat frame 1 and held by the engagement piece 13 and the binding frame 3 in the same way as that in FIG. 4 as described above.

Furthermore, a bolt 4 is inserted into a through-bore 6 and screwed into a threaded bore 5. Thus, the binding frame 3 is fixed to the seat frame 1. The net member 2 is now firmly fixed to the seat frame 1.

FIG. 10 is a perspective view which clearly shows the claw 12 and notches 12*a* at each end of the claw 12.

Figure 11:
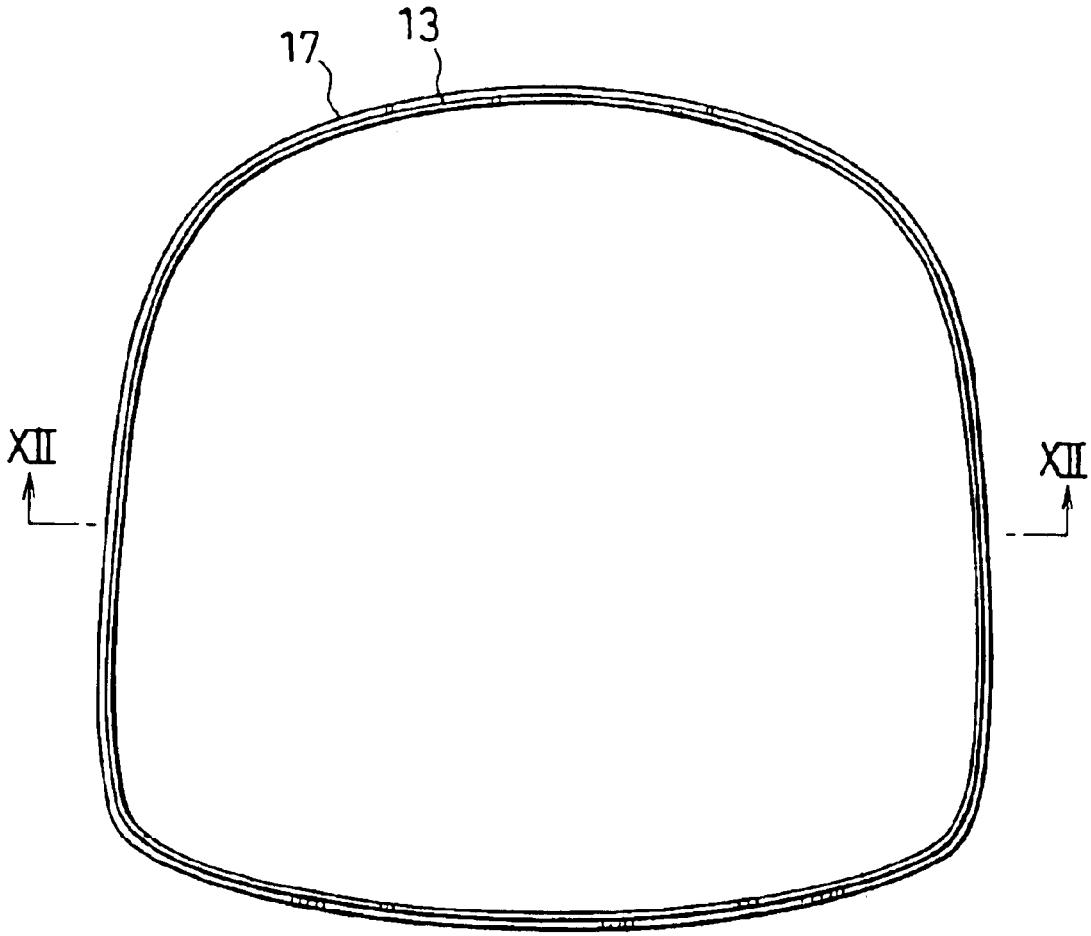
FIG. 11 is a top plan view of the engagement piece.
Figure 12:
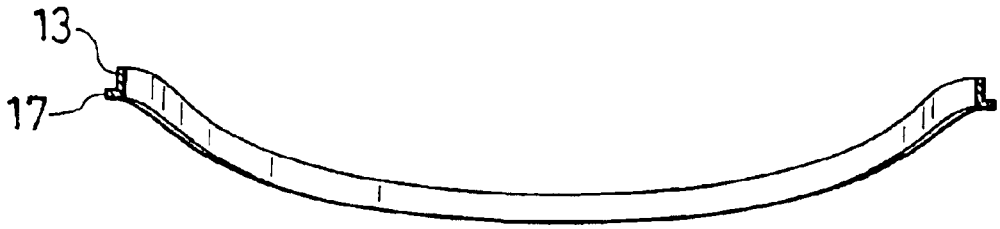
FIG. 12 is a vertical sectional front view taken along the line XII—XII in FIG. 11.
Figure 13:
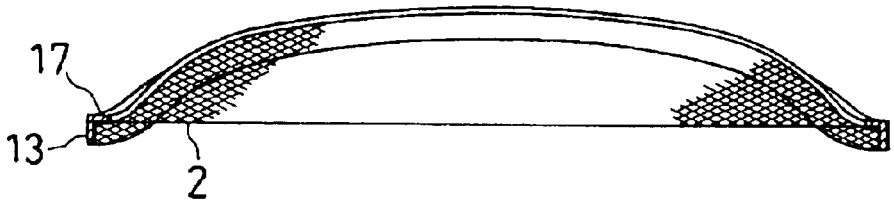
FIG. 13 is a front view of the engagement piece covered with the net member.
Figure 14:
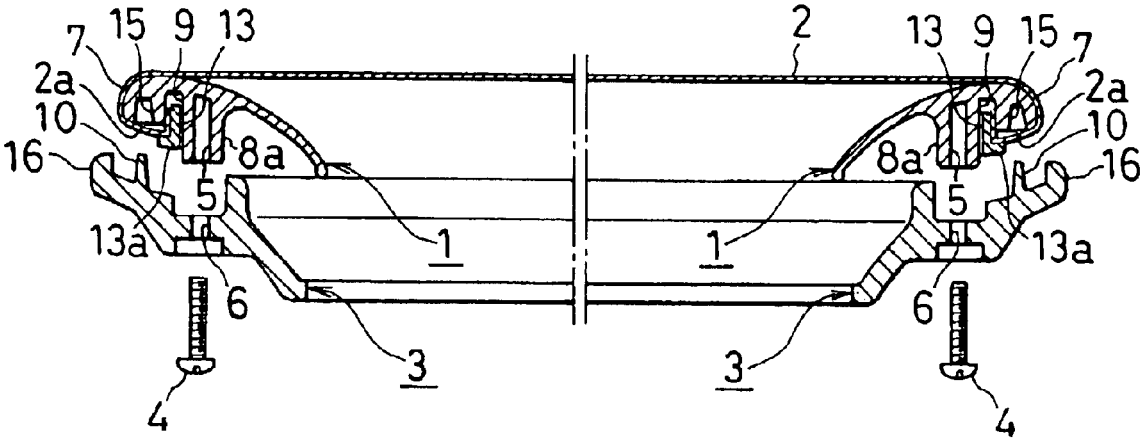
FIG. 14 is a vertical sectional front view when the engagement piece and net member of FIG. 13 are mounted to the seat frame.

FIGS. 11 and 12 are a top plan view and a vertical sectional view taken along the line XII—XII in FIG. 11 respectively of the engagement piece 13. FIG. 13 is a front view of the engagement piece covered with the net member 2, and FIG. 14 is a vertical sectional front view when the engagement piece 13 and net member 2 of FIG. 13 are mounted to the seat frame 1.

FIGS. 15 to 18 illustrate the second embodiment of the present invention in which a peripheral groove 17 is formed on the upper outer circumferential surface of the seat frame 1. An edge member 18 is engaged on the peripheral groove 17 to apply outward force to a net member 2. The peripheral groove 17 and the edge member 18 may be preferably provided on the whole circumference of the seat frame 1. The edge member 18 may be made of flexible synthetic resin wire such as soft polyurethane having a diameter of 3 to 10 mm.

Figure 15:
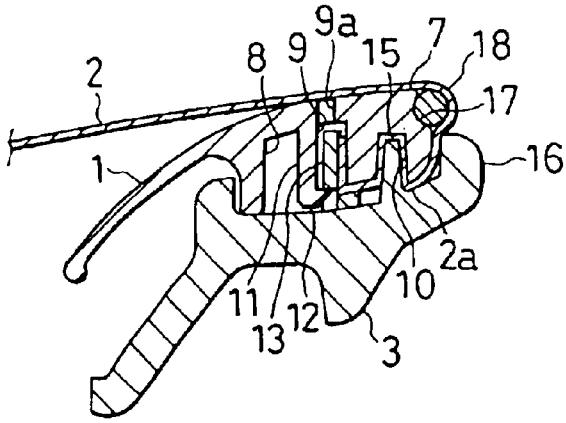
FIG. 15 is a vertical sectional view of the second embodiment of the invention, similar to FIG. 6.
Figure 16:
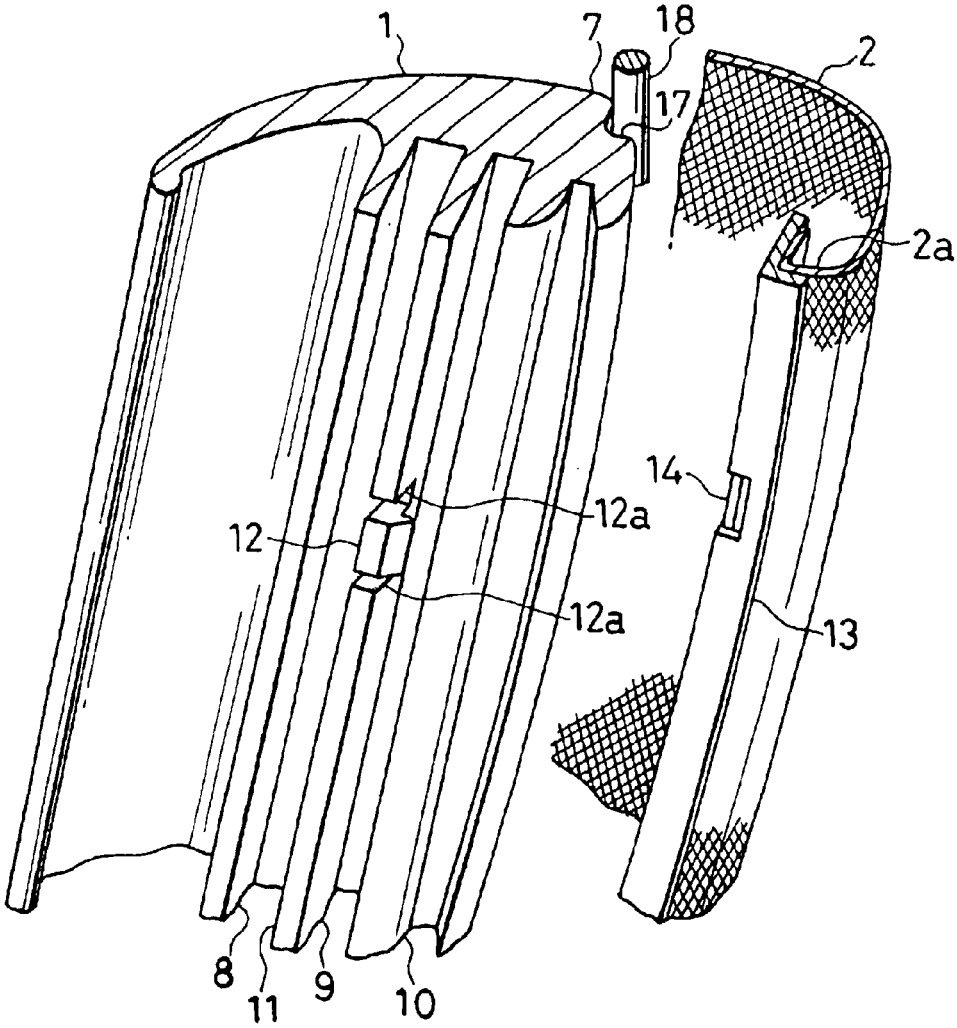
FIG. 16 is a perspective view of the embodiment in FIG. 15.
Figure 17:
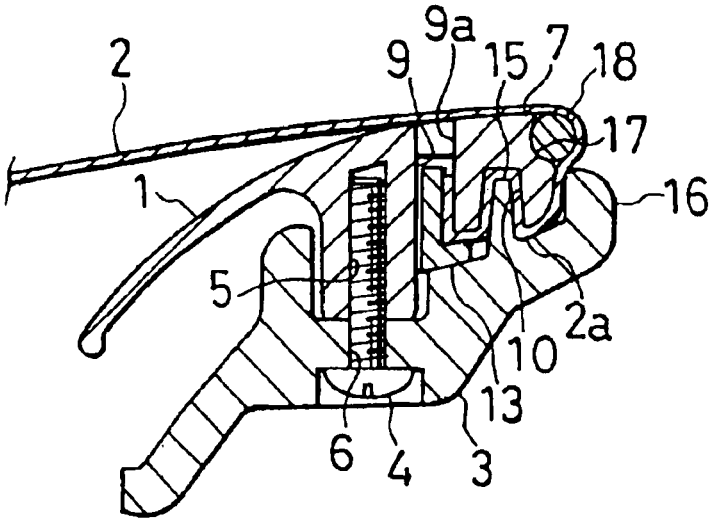
FIG. 17 is a vertical sectional view of the second embodiment of the invention, similar to FIG. 8.

FIG. 16 is a perspective view of FIG. 15, and FIG. 17 is a vertical sectional view of a portion having a bolt and the edge member 18.

Owing to the edge member 18 in the peripheral groove 17, stronger tensile force is applied to the net member 2 uniformly.

Figure 18:
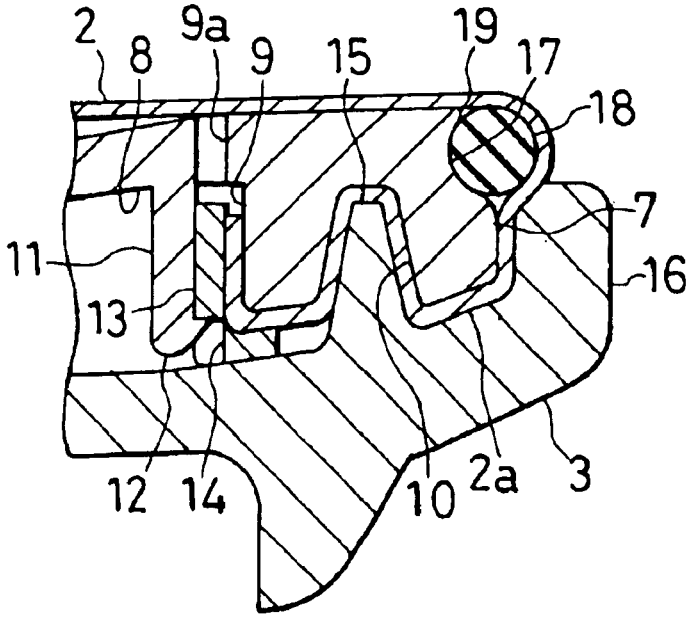
FIG. 18 is an enlarged vertical sectional view of the third embodiment of the invention.

The third embodiment of the present invention is shown in FIG. 18, in which a protrusion 19 is formed at the upper end of a peripheral groove 17. An edge member 18 and a net member 2 are firmly held between the protrusion 19 and a protection flange 16 of a binding frame 3 thereby preventing escape of the edge member 18 and elongation of the net member 2.

Figure 19:
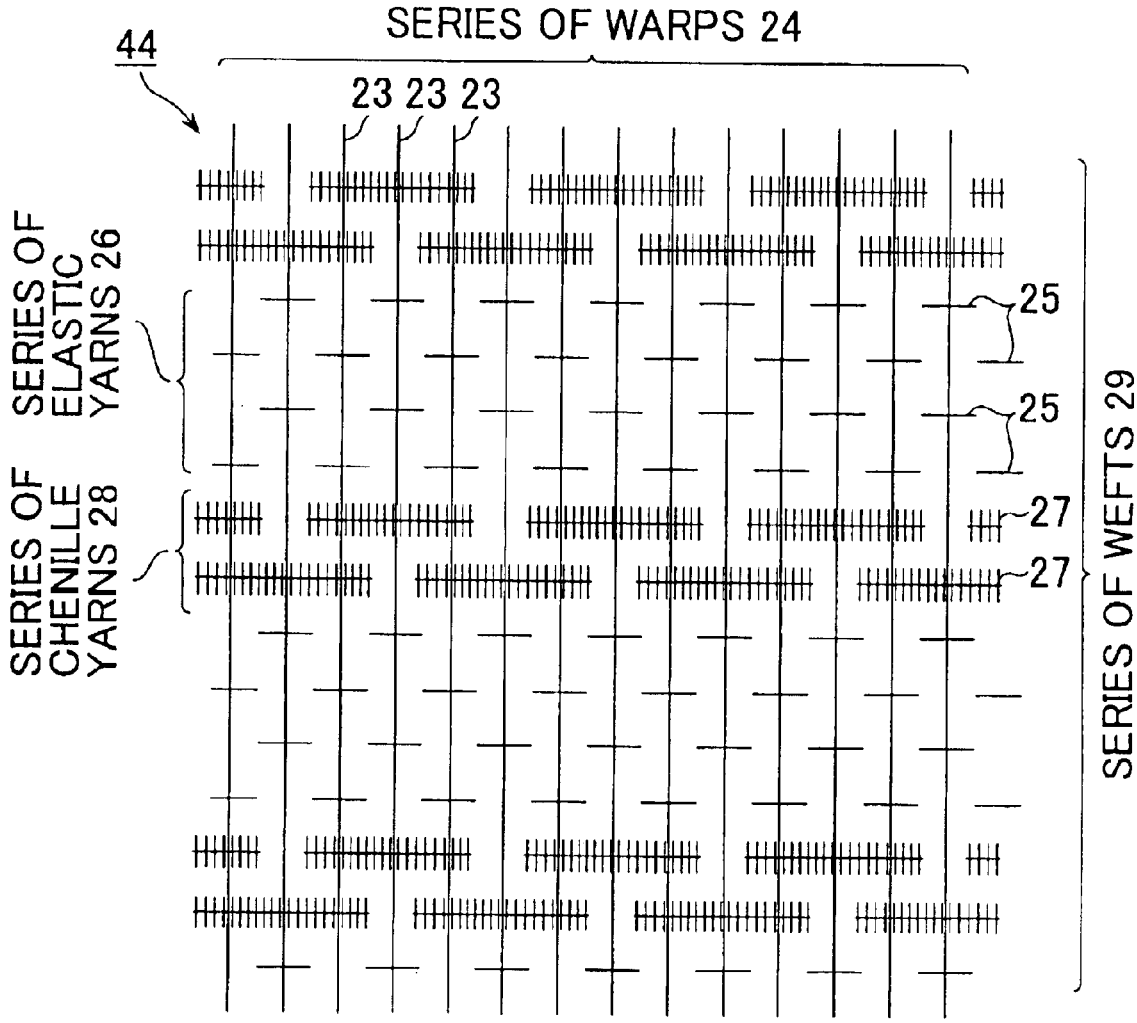
FIG. 19 is a schematic view of the woven mesh structure for the seat.

A mesh-stretched chair is schematically shown in FIG. 19, in which a mesh 44 for the seat "B" comprises a woven or knitted structure of a series of warps 24 and a series of wefts 29 crossed thereto. The series of warps 24 comprise a number of high tension warps 23; and the series of wefts 29 comprises a series of elastic yarns 26 of a number of elastic yarns 25 and a series of chenille yarns 28 of a number of chenille yarns 27.

In the example, the series of elastic yarns 26 comprise four elastic yarns 25, and the series of chenille yarns 28 comprise two chenille yarns 27. The warp 23 may be preferably made of polyester multufilament having 500 deniers.

The elastic yarn 25 may be preferably polyether-ester elastic yarn having a diameter of 100 to 3000 deniers and a dry shrinkage rate of 5 to 50% at 150° C.

The chenille yarn 27 comprises a polyester fiber core entangled by a filament-processed fluff.

The chenille yarns 27 on the front surface may be preferably more than the warps 23, such as at a ratio of 3:1. The elastic yarns 25 may preferably appear on the front surface with respect to the warps 23 at a ratio of 1:1 which means they are equal on both the front and rear surfaces.

FIG. 19 shows the mesh 44 as a woven structure, but the mesh 44 may be preferably a knitted structure as described later.

The seat "B" is stretched to the seat frame 1 such that the warps 23 are placed in a depth direction in the mesh 44 thus formed, thereby providing comfortable seat-sitting capability and increasing frictional force enough to hold a sitting person on the surface of the seat of the chair.

Figure 20:
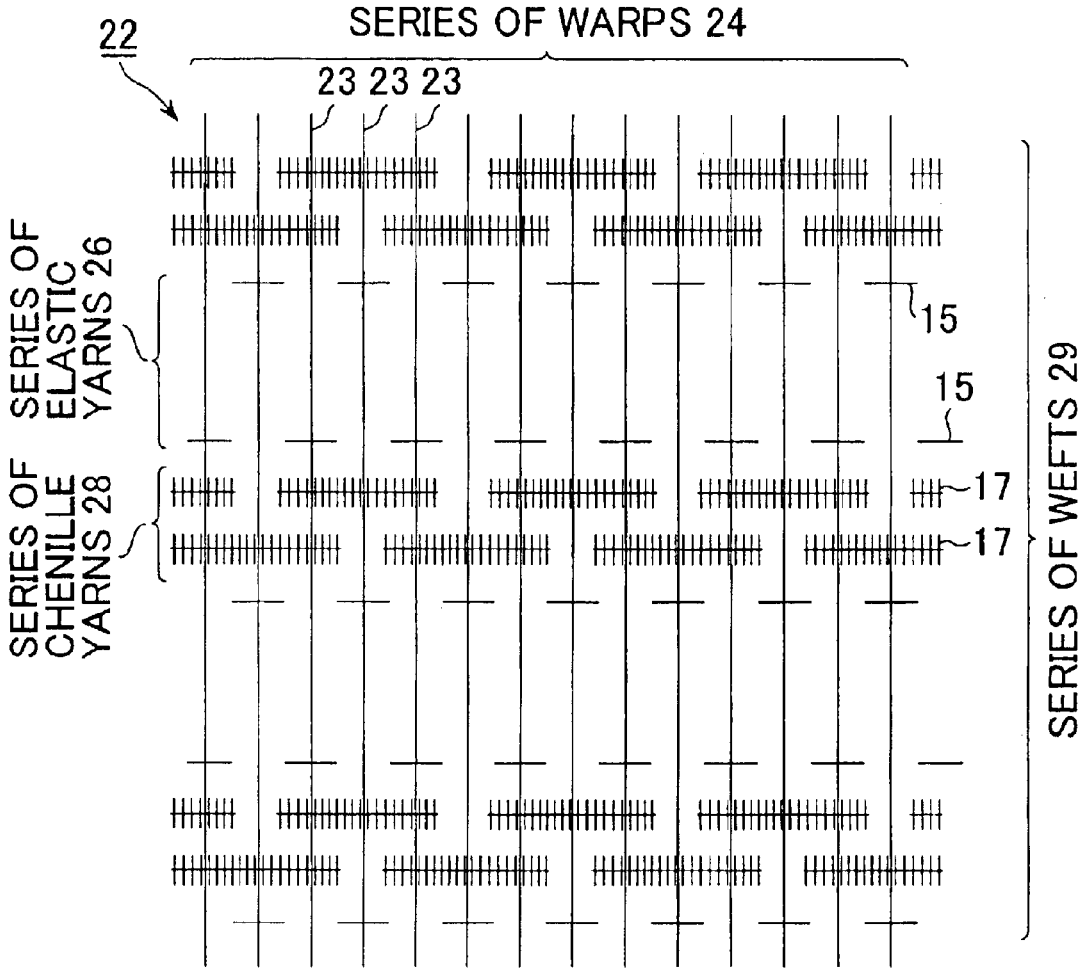
FIG. 20 is a schematic view of the woven mesh structure for the backrest.

As shown in FIG. 20, in a mesh 22 for the backrest "A", two middle elastic yarns 25 are deleted from the series of elastic yarns 26 of the mesh 44 for the seat "B" as shown in FIG. 19 to produce a space. Specifically, in the mesh 22, two elastic yearns 25 in the series of elastic yarns 26 are spaced far away from each other and disposed closer to the series of chenille yarns 28 comprising two chenille yarns 27, 27 closer to each other. The other structure in the mesh 22 is similar to that of the mesh 44, and the same numerals are allotted to the same members. Detailed description thereof is omitted.

In the mesh 22, the warps 23 are stretched vertically over the frame 21 of the backrest "C". Thus the mesh 22 is slightly weaker in elasticity in a width direction than that over the seat "B", but provides better strength in a depth direction. In addition, similar advantages to the mesh over the seat "B" are achieved by the backrest "C".

Figure 21:
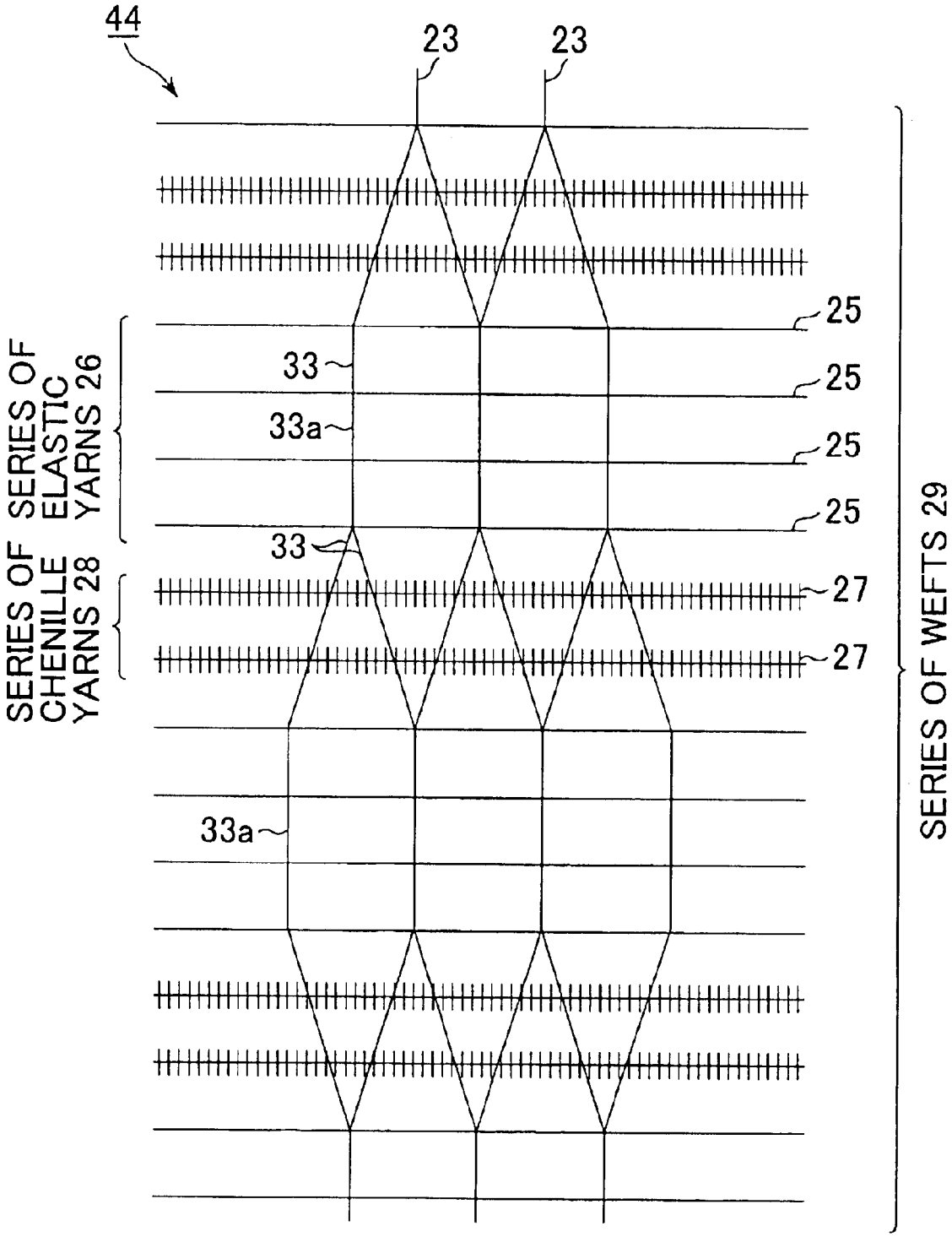
FIG. 21 is a schematic view of the knitted mesh structure for the seat.
Figure 22:
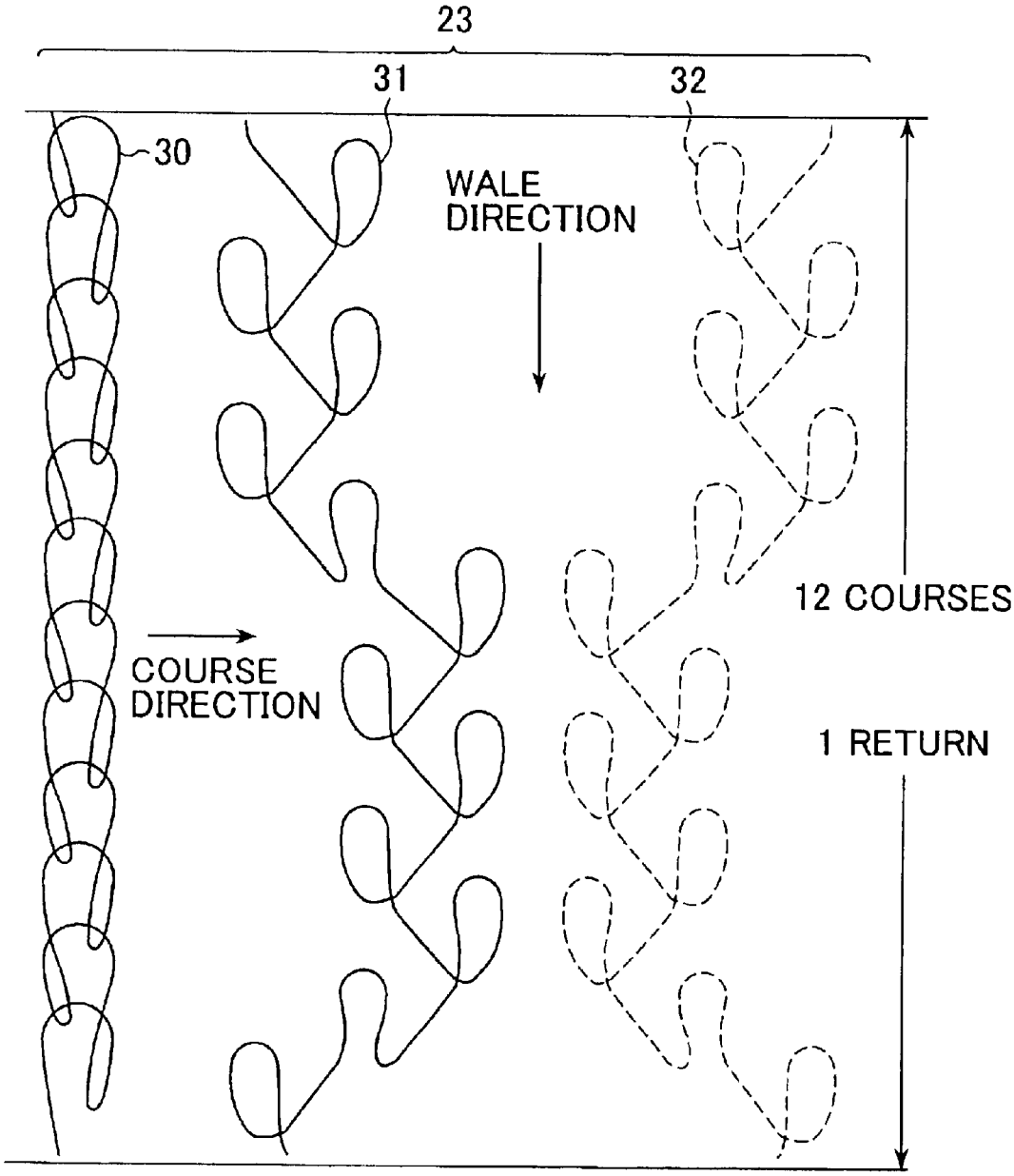
FIG. 22 is a schematic view which shows the knitted mesh structure of warps.
Figure 23:
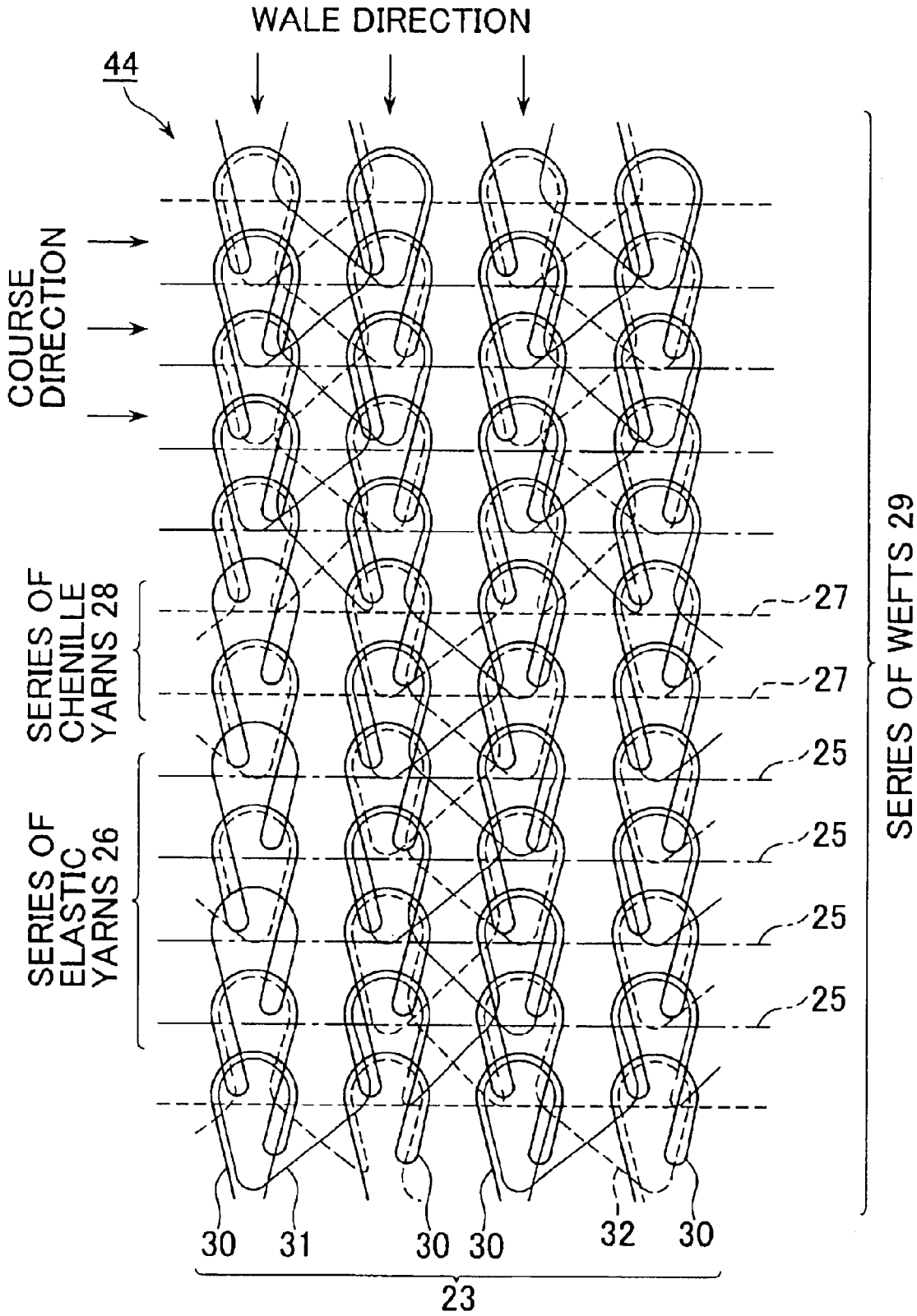
FIG. 23 is a schematic view of the knitted mesh structure for the seat.

FIG. 21 illustrates another example of a knitted mesh 44 for the seat "B". In this example, as shown in FIG. 22, warps 23 comprise three kinds of knitted yarns consisting of a chain yarn 30, the first knitted yarn 31 and the second knitted yarn 32, which are warp-knitted with the warp-knitted structure in FIG. 22 using a raschel machine having a warp-insertion device, to form a hexagonal mesh structure 33 as shown in FIG. 21. Simultaneously, a series of elastic yarns 26 comprising four elastic yarns 25 similar to those in FIG. 19 is knitted as weft with vertical straight portions 33*a*, and a series of chenille yarns 28 comprising two chenille yarns 27,27 is knitted as weft with tilted portions of the hexagonal mesh structures 33 to form a knitted mesh 44 as shown in FIG. 23.

For example, 100 deniers polyester filaments may be used as reinforcement chain yarn, and elastic yarns may be used to provide elasticity. The first and second mesh knitted yarns 31,32 may be 500 denieres polyester multifilaments. What are similar to the above may be used as the chenille yarns 27.

A mesh 22 for the backrest "A" may be the same as a mesh in which two middle elastic yarns 25,25 are deleted from the series of elastic yarns 26 which cross the straight portions 33*a* of the hexagonal mesh structures 33.

The knitted mesh 44 is mounted to the seat frame 3 so that the warps 23 are placed in a depth direction of the seat "B" as well as the woven mesh, and the knitted mesh 22 is mounted to the backrest frame 21 so that the warps 23 may be placed in a vertical direction of the backrest "A".

The number of the elastic yarns 25 of the wefts in the mesh 22 for the backrest "A" is smaller than that that in the mesh 44 for the seat "B". This is because load applied to the backrest "A" is smaller than that applied to the seat "B". Furthermore a larger space in the mesh assures a heightened sense of appearance and texture in the design.

The meshes 22,44 may comprise knitted one in which the warps 23 are knitted to the hexagonal mesh structure, but is not limited thereto.

The numbers of the elastic and chenille yarns as wefts may be freely determined. According to changes in the number of yarns, various patterns and designs are possible.

The foregoing merely relate to embodiments of the invention. Various changes and modifications may be made by a person skilled in the art without departing from the scope of claims wherein:

What is claimed is:

1. A structure for mounting a net to an element of a chair, the structure comprising:

a basic frame for supporting the element of the chair, the basic frame having a peripheral region and a lower surface provided with an engagement groove into the basic frame from the lower surface;

a net covering the element of the chair and wrapping around the peripheral region of the basic frame, the net having a peripheral edge;

an engagement piece attached to the peripheral edge of the net, the engagement piece being insertable, with the net attached to the engagement piece, into the engagement groove of the basic frame; and a binding frame coupled to the lower surface of the basic frame for mounting the net to the basic frame.

2. The structure of claim 1, wherein the basic frame includes a flexible engagement claw inside the engagement groove and the engagement piece attached to the net includes an engagement recess elastically engageable with the engagement claw of the basic frame to prevent the engagement piece from coming falling out of the engagement groove.

3. The structure of claim 1, wherein the engagement piece is L-shaped including a horizontal portion structured to support a pressing force exerted by the binding frame when the binding frame is coupled to the basic frame.

4. The structure of claim 1, wherein the basic frame has an upper surface provided with a vertical through-bore in an area of the basic frame at the engagement groove.

5. The structure of claim 1, wherein the basic frame also includes a form-fitting groove, and the binding frame includes a projection structured to be received in the form-fitting groove of the basic frame when the basic frame is coupled to the binding frame, the net being positioned between the form-fitting groove and the projection so that the projection of the binding member applies tension to the net when the basic frame is coupled to to the binding frame.

6. The structure of claim 1, wherein the peripheral region of the basic frame includes a peripheral groove therein, the structure further comprising:

an edge member positionable within the peripheral groove for outwardly applying a tensile force to the net.

7. The structure of claim 6, wherein the edge member is comprised of flexible synthetic resin.

8. The structure of claim 6, wherein the peripheral groove and the edge member are formed over the entire peripheral region of the basic frame.

9. The structure claim 6, wherein the basic frame includes a protrusion formed at an upper end of the peripheral groove, and the binding frame includes a peripheral flange, the said edge member and the net being held between the protrusion and the peripheral flange of the binding frame.

10. A method of mounting a net to a basic frame for a seat or backrest of a chair, comprising the steps of:

providing a net having a periphery with an engagement piece secured thereto;

covering an upper surface and an outer peripheral side surface of the basic frame with the net after the periphery of the net is secured to the engagement piece;

folding said the net inwardly around the outer peripheral surface of the basic frame;

inserting the engagement piece, with the net attached thereto, into an engagement groove of the basic frame;

pressing a binding frame onto a lower surface of the basic frame to urge the engagement piece further into the engagement groove of the basic frame so that a tensile force is applied to the net; and coupling the binding frame to the basic frame to mount the net to the basic frame.

11. The method of claim 10, wherein the basic frame includes a flexible engagement claw inside the engagement grooves, the engagement claw being structured to prevent the engagement piece from falling out of the engagement groove when the engagement piece is urged further into the engagement groove during the pressing step.

12. The method of claim 10, further comprising the step of inserting an edge member into a peripheral groove on the outer peripheral surface of the basic frame after the pressing step to increase the tensile force applied to the net.

13. A chair, comprising:

a seat and a backrest;

a respective frame for at least one of the seat and the backrest; and a mesh woven or knitted over the respective frame, the mesh comprising:

high-tension warps stretched along a vertical direction or a depth direction of the respective frame; and welts comprising a plurality of elastic yarns and a plurality of chenille yarns stretched along a width direction of the respective frame.

14. The chair of claim 13, wherein the warps are made of polyester multifilament.

15. The chair of claim 13, wherein the elastic yarns are made of polyether ester elastic yarns.

16. The chair of claim 13, wherein the chenille yarns are made of polyester fiber core yams twisted by filament-processed fluffs.

17. The chair of claim 13, wherein the chenille yams appear more than warps in a front surface of the mesh.

18. The chair of claim 13, wherein the backrest and the seat are provided with respective frames, and the elastic yarns stretched over the frame of the seat and the elastic yams stretched over the frame of the backrest have first and second densities, respectively, the first densities being higher than the second densities.

19. The chair of claim 13, wherein the warps comprise a knitted hexagonal mesh structure having straight and tilted portions, a plurality of elastic yarns knitted as wefts in the straight portions of the hexagonal mesh structure and a plurality of chenille yarns knitted as wefts in the tilted portions of the hexagonal mesh structure.

20. The structure of claim 1, wherein the engagement groove and the engagement piece are both annularly shaped.

21. The structure of claim 1, wherein the element of the chair comprise a scat or a backrest.

22. The structure of claim 1, further comprising a coupling arrangement for coupling the binding frame to the basic frame.

23. The structure of claim 22, wherein the coupling arrangement includes at least one bolt.

24. The structure of claim 22, wherein the binding frame includes a through-bore and the basic frame includes a threaded bore, the bolt being insertable within the through-bore and the threaded bore for coupling the binding frame to the basic frame.

25. The method of claim 10, further comprising inverting the engagement piece before inserting the engagement piece into the engagement groove of the basic frame.

26. The method of claim 10, further comprising securing the periphery of the net to the engagement piece before covering the upper surface and outer peripheral surface of the basic frame with the net.

* * * * *